United States Patent [19]

Kato

[11] 4,078,025

[45] Mar. 7, 1978

[54] CARBURETOR

[75] Inventor: Takashi Kato, Susono, Japan

[73] Assignee: Yoyota Jidosha Kogyo Kabushiki Kaisha, Toyota, Japan

[21] Appl. No.: 732,057

[22] Filed: Oct. 13, 1976

[30] Foreign Application Priority Data

Jul. 13, 1976 Japan ..... 51/83079

[51] Int. Cl.[2] ..... F02M 7/06

[52] U.S. Cl. ..... 261/41 D; 261/47; 123/119 DB

[58] Field of Search ..... 261/41 D, 63, 47; 123/119 DB

[56] References Cited

U.S. PATENT DOCUMENTS

| | | | |
|---|---|---|---|
| 1,767,664 | 6/1930 | Geiger | 261/41 D |
| 1,838,675 | 12/1931 | Heitger | 261/41 D |
| 1,956,367 | 4/1934 | Becker et al. | 261/41 D |
| 2,694,560 | 11/1954 | Olson | 261/41 D |
| 3,151,604 | 10/1964 | Walker et al. | 261/41 D |
| 3,319,944 | 5/1967 | Brenneman | 261/41 D |

FOREIGN PATENT DOCUMENTS

| | | | |
|---|---|---|---|
| 1,246,560 | 9/1971 | United Kingdom | 261/41 D |

*Primary Examiner*—Tim R. Miles

*Attorney, Agent, or Firm*—Birch, Stewart, Kolasch & Birch

[57] ABSTRACT

A carburetor having an air port provided adjacent a slow port so as to supply air from the air port when fuel is supplied from the slow port in a slow speed operation of the engine, the air port being biassed with respect to the slow port so that the supply of air from the air port is more rapidly reduced than the supply of fuel from the slow port in the transition region from a slow speed operation to the normal operating condition, thereby compensating for a delay in the fuel supply from a main nozzle in the transition region.

4 Claims, 5 Drawing Figures

CARBURETOR

BACKGROUND OF THE INVENTION

1. Field of the Invention

The present invention relates to a carburetor and, more particularly, an improvement of the carburetor with regard to its fuel injection performance in a transient region between the slow operation wherein fuel is principally supplied from a slow fuel supply system and the normal operation wherein fuel is principally supplied from a main fuel supply system.

2. Description of the Prior Art

When a carburetor for an automobile internal combustion engine is operating in the slow speed or idling condition wherein the throttle valve is substantially or completely closed, no substantial vacuum is generated in the Venturi portion and, accordingly, a substantial small amount of fuel is drawn out from the main nozzle. Because of this, the carburetor is generally provided with a slow port which opens to the intake passage at a position close to an end of the throttle valve in its closed position and an idle port which opens to the intake passage and displaced a small distance from the slow port toward the downstream side so that in the slow speed or idling condition fuel is drawn into the intake passage from these ports. The position and the opening of the slow and idle ports are determined in a manner such that when the engine is operating in a predetermined slow speed or idling condition, a predetermined amount of fuel necessary for stable slow speed engine operation or idling is drawn from these ports by a vacuum due to an air flow through a clearance formed between the slow port and the end portion of the throttle valve positioned to closely oppose the port or an intake vacuum applied to the idle port when the throttle valve is completely closed. The flow of fuel through a slow fuel supply system including the slow port is controlled by a jet means called "slow jet". In the prior art carburetors, a slow fuel passage including the slow jet is branched from a main fuel passage extending from a float chamber to the main nozzle at a portion downstream of a main jet incorporated in the main fuel passage. This is due to the reason that if the main and slow fuel passages are individually connected to the float chamber, when the throttle valve is gradually opened from its substantially closed position, the supply of fuel from the slow fuel supply system is maintained for a while even when the supply of fuel from the main fuel supply system has started, thereby causing an overrich fuel-air mixture in a transient region from a slow to a medium speed operation. When the slow fuel passage is branched from the main fuel passage, at a downstream portion of the main jet, the amount of fuel supplied from the slow port is instantly reduced as the supply of fuel from the main nozzle begins, thereby ensuring transition of fuel supply from the slow fuel supply system to the main fuel supply system as the throttle valve is opened. In this case, therefore, the aforementioned overrich fuel-air mixture in the transient region is avoided.

FIG. 1 shows the fuel flow performance of conventional prior art carburetors. In FIG. 1, the abscissa represents the opening of the throttle valve while the ordinate represents the flow of fuel supplied from the carburetor to the intake passage. In the figure, curve $G_I$ shows the flow of fuel supplied from the idle port, curve $G_L$ shows the flow of fuel supplied from the slow port, curve $G_M$ shows the flow of fuel supplied from the main nozzle, and curve $G_T$ shows the total of the three fuel flows.

In this conventional prior art carburetor, when the main fuel supply system begins to supply fuel in the transient region from the slow speed condition to the normal operating condition (the region shown by C in FIG. 1), the fuel supply from the slow port is instantly reduced as explained above and, therefore, there is no problem of causing an overrich condition of fuel-air mixture in the transient region. On the contrary, however, since there is a delay in the actual delivery of fuel from the main nozzle, a temporary shortage of fuel is caused thereby causing a supply of an overlean fuel-air mixture in the transient region which inhibits the performance of the engine in acceleration from the idling or slow speed condition. Particularly when the engine is operated by a relatively lean fuel-air mixture for the purpose of purifying exhaust gases, the engine may readily stall due to the aforementioned temporary shortage of the fuel supply. Therefore, this situation is an important problem to be solved in the lean combustion engine.

SUMMARY OF THE INVENTION

Therefore, it is the object of the present invention to solve the aforementioned problem of causing the overlean fuel-air mixture in the transition from the slow fuel supply system to the main fuel supply system in the conventional prior art carburetor having the slow system and to provide an improved carburetor having a stable performance of providing a desirable air/fuel ratio throughout the transient region from the slow speed operation to the normal operating condition.

According to the present invention, the above-mentioned object is accomplished by a carburetor comprising an intake passage including a Venturi portion, a throttle valve provided in said intake passage downstream of said Venturi portion, a main nozzle which opens to the inside of the said Venturi portion, a slow port which opens to said intake passage at a position which is upstream of said throttle valve when it is closed and downstream of said throttle valve when it is opened for more than a predetermined opening. In addition, the present invention includes a float chamber, and main and slow fuel passages extending from said float chamber to said main nozzle and to said slow port, wherein the improvement comprises an air port which opens to said intake passage at a position which is upstream of said throttle valve when it is closed and downstream of said throttle valve when it is opened greater than a predetermined opening, said air port being biased with respect to said slow port so that said air port is traversed by said throttle valve earlier than said slow port in the opening process of said throttle valve.

In the carburetor of the abovementioned constitution, the slow system is adjusted in a manner such that it provides a fuel-air mixture of a predetermined air/fuel ratio when said air port is effectively operating to supply a predetermined amount of air by reducing the flow of air supplied across the throttle valve relative to the amount of fuel supplied from the slow port in the slow speed operation. Thus, when the throttle valve is gradually opened from the idling or slow speed operating condition to traverse the slow port and the air port, the supply of air from said air port is reduced prior to the reduction of the fuel supply from the slow port in such a timing that compensates the delay of fuel supply from the main nozzle relative to a reduction in the fuel supply from the slow port. This delay avoids the generation of an overlean fuel-air mixture in the transition from the slow fuel supply system to the main fuel supply system.

The amount of air supplied from the air port is determined by the opening of the air port. However, since the opening of the air port must be determined in relation to the opening of the slow port, it is favorable that an air jet is provided in the flow path of an air passage extending to the air port so as to optionally control the amount of air supplied from the air port.

According to an additional feature of the present invention, a shut-off valve may be provided in the flow path of said air passage so as to cut off the air supply from the air port when the engine is in a cold state. By cutting off the air supply from the air port in the cold state of the engine, a richer fuel-air mixture is supplied in the transitional region from the slow speed operation to the normal operation, whereby a combustion of the fuel-air mixture in a cold state of the engine is facilitated, thereby contributing to an improvement of the engine performance in a cold state.

According to another feature of the present invention, the air passage for supplying air to the air port may have its entrance open to the intake passage at a downstream portion of a choke valve provided in the intake passage. In this case, the supply of air from the air port is controlled by the choke valve and, consequently, a good performance of the engine is maintained even in a cold state of the engine without providing the aforementioned cut-off valve in said air passage.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

In the following, the invention will be described in more detail with respect to a preferred embodiment with reference to the accompanying drawings.

Figure 1:
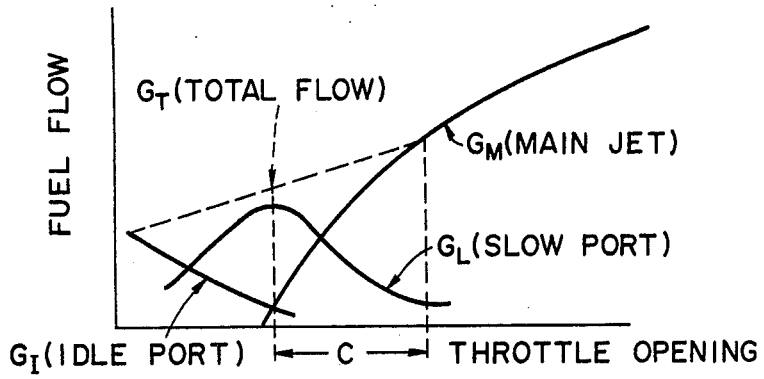
FIG. 1 is a graph showing the fuel supply performance in a conventional carburetor incorporating an idle port, a slow port and a main port.
Figure 2:
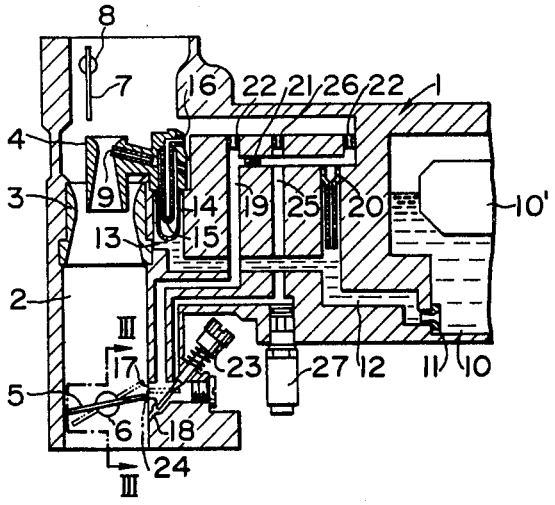
FIG. 2 is a longitudinal sectional view illustrated partly in a schematical manner a portion, of a two-barrel type carburetor in which the present invention is incorporated.
Figure 3:
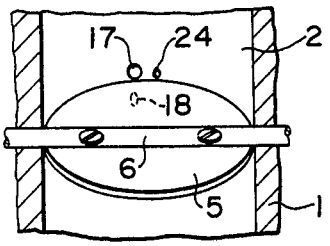
FIG. 3 is an enlarged sectional view along lined III—III in FIG. 2.
Figure 4:
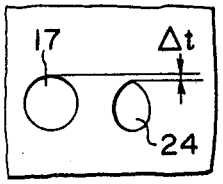
FIG. 4 is a view showing the relation between the slow port and the air port.

Referring particularly to FIGS. 2–4, 1 designates the body of a two-barrel type carburetor. FIG. 2 shows only the first bore side of the carburetor in which the present invention is incorporated. The body 1 is formed with an intake passage (first bore) 2 therein. In the intake passage 2 is provided a large Venturi 3, and in the throat portion of the large Venturi is provided a small Venturi 4. In the intake passage, at a downstream portion of the large Venturi 3 is provided a throttle valve 5 supported by a pivot shaft 6 to be rotatable around its axis. In addition, at an upstream portion of the small Venturi 4 is provided a choke valve 7 supported by a pivot shaft 8 to be rotatable around its axis. A main nozzle 9 opens at a throat portion of the small Venturi 4. The main nozzle is adapted to be supplied with fuel (gasoline) contained in the float chamber 10 through a main fuel passage 12 including a main jet 11 provided in the flow path thereof to control the flow of fuel therethrough. The main fuel passage 12 also includes a well 13, provided in the flow path thereof, said well containing an outer tube 14 and an inner tube 15. The outer and inner tubes are formed with several small openings, whereby the fuel brought into the well 13 enters into a chamber defined between the outer and inner tubes through said small openings. In the chamber the fuel is mixed with the air which has been introduced into the chamber through an air bleed 16 and the small openings formed in the inner tube 14, thereby providing a premixture of gasoline and air which is then supplied to the main nozzle 9.

A slow port 17 opens to the intake passage 2 at a position shown in FIG. 2 which is upstream of the throttle valve 5 when it is closed and is downstream of the throttle valve when it is slightly opened. Slightly downstream of the slow port 17 or at a position which is constantly located downstream of the throttle valve 5, irrespective of its opening, an idle port 18 opens to the intake passage. The slow and idle ports 17 and 18 are supplied with a part of the fuel which has passed the main jet 11 and a part of the main fuel passage 12 through a slow fuel passage 19 which is branched from a middle portion of the main fuel passage under the control applied by a slow jet 20 and an economizer jet 21. The slow fuel passage 19 is equipped with a slow air bleed 22, whereby the fuel drawn into the slow fuel passage 19 is mixed with air drawn through the slow air bleed, thereby generating a fuel-air mixture which is then supplied to the slow and idle ports 17 and 18. The fuel flow from the slow port 17 is adjusted by the slow jet 20 and the economizer jet 21, whereas the fuel flow from the idle port 18 is further adjusted independently of the slow port by an adjust screw 23.

The float chamber 10 includes a float 10' and is adapted to contain a constant level of fuel as well known in the art.

An air port 24 opens in the intake passage 2 at a position shown in FIG. 2 which is upsteam of the throttle valve 5 when it is closed and is downstream of the throttle valve when it is slightly opened. The air port 24 is connected with an air passage 25 which communicates at its other end to the intake passage 2 at a position which is downstream of the choke valve 7 and is upstream of the small Venturi 4. The air passage 25 includes an air jet 26 in the flow path thereof. The air port 24 is provided in relation to the slow port 17 as shown in more detail in FIGS. 3 and 4. In the shown embodiment, the downstream edge of the air port 24 is located substantially at the same level as the downstream edge of the slow port 17. From this lower end the air port 24 gradually increases its opening width toward its upper or upstream side just in the same manner as the slow port 17 but soon the slow port begins to reduce its opening width prior to the slow port so as to terminate at its upper or upstream edge which is displaced by $\Delta t$ to the downstream side with respect to the upstream edge of the slow port.

In the shown embodiment, an electromagnetic valve 27 is provided at a middle portion of the air passage 25 so as to selectively cut off the passage. The electromagnetic valve 27 is operated by an electric circuit (not shown) in such a manner such that the valve cuts off the air passage 25 when the engine is in a cold state.

In operation, when the engine is in the idling condition with the throttle valve 5 closed as shown by solid lines in FIG. 2, the slow port 17 and the air port 24 are both positioned upstream of the throttle valve 5. Consequently, neither fuel nor air is drawn into the intake passage 2 through these ports and the engine will maintain a stable idling operation by a predetermined flow rate of fuel supplied from the idle port 18 which opens to the intake passage 2 at the downstream side of the throttle valve 5.

When the throttle valve 5 is slightly opened from its full closed position so that an edge portion of the valve opposes the slow port 17, a relatively strong air stream is generated through a clearance formed between the opposing edge portion of the throttle valve and the slow port, whereby a vacuum is applied to the slow port 17 and causes a drawing-out of fuel from the slow port. Simultaneously, the air port 24 is also applied with the vacuum and air is drawn out from the air port toward the intake passage 2. The flow rates of fuel and air supplied from the slow port 17 and the air port 24 individually increase almost in the same manner up to the respective maximum values as shown by fuel flow line $G_L$ and air flow line $A_L$ in FIG. 5. In this slow operating region, therefore, an amount of air proportional to that of the fuel supplied from the slow port 17 is supplied from the air port 24 and, if the carburetor is designed so that the air flow rate generated across the throttle valve 5 in the slow operating region is smaller than the total required air flow rate by an amount which corresponds to the air supplied from the air port 24, the slow operation of the engine is stably maintained just in the same manner as in the conventional carburetor throughout this slow operating region.

Figure 5:
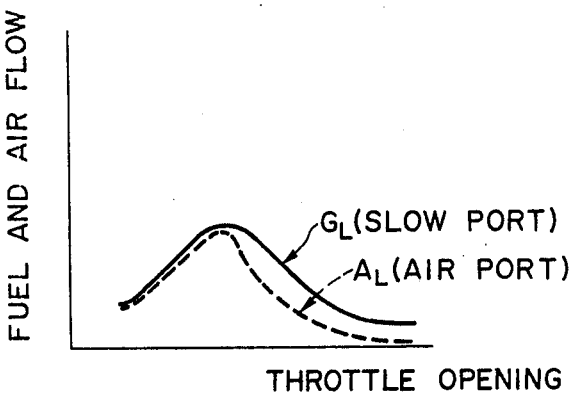
FIG. 5 is a graph showing the relationship between the fuel flow performance of the slow port and the air flow performance of the air port in the carburetor of the present invention.

When the throttle valve 5 is further opened so that a substantial air stream is generated through the small Venturi 4 so as to initiate fuel delivery from the main nozle 9, the fuel supply from the slow port 17 abruptly begins to decrease for the reasons that the fuel supply controlled by the main jet 11 principally flows toward the main nozzle and that the clearance between the edge portion of the throttle valve and the slow port 17 abruptly increases thereby correspondingly lowering the speed of the air stream therethrough thereby correspondingly reducing the vacuum applied to the slow port. This operating condition is called the transient region from the slow speed operation to the normal operating condition. In the transient region, the vacuum applied to the air port 24 also abruptly reduces as the vacuum applied to the slow port 17 reduces thereby causing a reduction in the air flow supplied from the air port 24 in accordance with a reduction in the fuel flow supplied from the slow port 17. However, due to the design of the air port 24 in relation to the slow port 17 as explained with reference to FIG. 4, the reduction in the air flow from the air port 24 occurs more rapidly than that in the fuel flow from the slow port 17 as shown in FIG. 5. Consequently, in the transient region the air supplied from the air port 24 is more rapidly reduced relative to the fuel supply from the slow port 17. This relative reduction in the supply of air from the air port 24 compensates for a temporary shortage of fuel due to the delay in the fuel supply from the main nozzle 9. Thus, the problem of temporary overleaning of fuel-air mixture in the transient region of the conventional carburetor is obviated.

It will be understood by those skilled in the art that the position and the shape of the air port 24 is not limited to those shown in the drawing and that they may be designed in various manner in accordance with particular characteristics of individual carburetors.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A carburetor comprising:

an intake passage including a venturi portion;

a throttle valve provided in said intake passage downstream of said venturi portion;

a main nozzle which opens to the inside of said venturi portion;

a slow port which opens to said intake passage at a position which is upstream of said throttle valve when it is closed and downstream of said throttle valve when it is opened for more than a predetermined opening;

a float chamber;

main and slow fuel passages extending from said float chamber to said main nozzle and to said slow port, respectively; and an air port which opens to said intake passage at a position which is upstream of said throttle valve when it is closed and downstream of said throttle valve when it is opened for more than a predetermined opening, said air port having the downstream edge arranged at substantially the same position as the downstream edge of said slow port with respect to the flow direction in said intake passage and an effective upstream edge arranged as displaced to the downstream side from the effective upstream edge of said slow port with respect to the flow direction in said intake passage.

2. The carburetor of claim 1, wherein said air port is provided relatively closely adjacent to one side of said slow port.

3. The carburetor of claim 1, further comprising an automatic valve means which selectively interrupts supply of air to said air port.

4. The carburetor of claim 1, further comprising a choke valve provided in said intake passage upstream of said venturi portion and an air passage means which connects an intake passage portion located between said choke valve and said venturi portion to said air port.

* * * * *

UNITED STATES PATENT AND TRADEMARK OFFICE

CERTIFICATE OF CORRECTION

PATENT NO. : 4,078,025

DATED : March 7, 1978

INVENTOR(S) : Takashi KATO

It is certified that error appears in the above–identified patent and that said Letters Patent are hereby corrected as shown below:

IN THE HEADING OF THE PATENT:

After "[73] Assignee:" change "Yoyota" to --Toyota--.

Signed and Sealed this

*Twenty-fifth* Day of *March 1980*

[SEAL]

*Attest:*

SIDNEY A. DIAMOND

*Attesting Officer*

*Commissioner of Patents and Trademarks*